United States Patent [19]

Sakutori

[11] 4,445,284

[45] May 1, 1984

[54] FOOTWEAR WITH INTEGRAL CUSHIONING AND VENTILATING APPARATUS

[76] Inventor: Eric M. Sakutori, 381 Waiehu Beach Rd., Wailuku, Hi. 96793

[21] Appl. No.: 350,082

[22] Filed: Feb. 18, 1982

[51] Int. Cl.[3] ..... A43B 7/08; A43B 7/06; A43B 13/20

[52] U.S. Cl. ..... 36/3 B; 36/3 R; 36/28; 36/29

[58] Field of Search ..... 36/3 R, 3 B, 28, 29

[56] References Cited

U.S. PATENT DOCUMENTS 1,433,309 10/1922 Stimpson ..... 36/3 B 2,098,412 11/1937 Bovay ..... 36/3 R 3,225,463 12/1965 Burnham ..... 36/29

4,000,566 1/1977 Famolare ..... 36/3 B

FOREIGN PATENT DOCUMENTS 1108108 5/1961 Fed. Rep. of Germany ..... 36/3 R

*Primary Examiner*—Louis Rimrodt

*Assistant Examiner*—Steven N. Meyers

*Attorney, Agent, or Firm*—Robert S. Smith

[57] ABSTRACT

A shoe which comprises an upper and a sole having a plurality of elongated chambers disposed therein and have fluid communication between the top face of the sole and the ambient surrounding the shoe.

2 Claims, 4 Drawing Figures

FOOTWEAR WITH INTEGRAL CUSHIONING AND VENTILATING APPARATUS

BACKGROUND OF THE INVENTION

This invention relates to footwear and particularly to footwear intended to improve the cushioning provided the foot of the wearer as well as the ventilation of the foot.

Joggers and long distance runners are particularly vulnerable to a number of ills because of the effects of their running or jogging activities. It is well known that joggers should land on the entire bottom surface of the foot, rather than the ball of the foot, to avoid injury. The sensitivity of the foot to the precise manner in which it strikes the ground is indicative of the importance of footwear that protects the wearer's foot from the repeated shock involved in such activity.

A lesser known problem also affects joggers and runners. Many runners and joggers have blood showing up in their urine. It is not an uncommon occurrence and it results from hemoglobin from the runner's blood passing out of the veins of the runner's feet as the result of trauma involved in long distance running. The hemoglobin, which gives the blood its distinctive color, migrates through the body and ends up in the urine of the runner.

Another problem frequently encountered in footwear, such as leather boots and the like, is that the leather boots contribute to discomfort because of sweating and consequential foot odors.

Other foot problems encountered by runners are described in The Complete Book of Running by James F. Fixx. These include blisters, stress fractures, bone bruises, plantar fasciitis and heel spur.

In addition to the problems encountered with the foot problems, other problems which the invention will also help to minimize relate to ankle problems and shin splints.

It is an object of the invention to provide footwear which provides greater comfort to the wearer than has been generally possible.

It is another object of the invention to provide footwear which provides cooling and comforting ventilation to the foot of the wearer.

It it another object of the invention to provide apparatus which reduces the trauma to the foot and entire body of the user, including ligaments, muscle and bone structure thereof so as to reduce consequent health problems.

It is another object of the invention to provide apparatus which is relatively inexpensive to manufacture.

SUMMARY OF THE INVENTION

The foregoing objects and other objects and advantages which shall become apparent from the detailed description of the preferred embodiment are attained in a shoe which comprises an upper and a sole having a plurality of elongated chambers disposed therein and which have fluid communication with the top face of the sole and the ambient surrounding the shoe.

The apparatus may further include a first check valve disposed in each of the elongated chambers to limit the direction of flow with respect to the elongated chamber with which it is associated. The first check valve is disposed at a first axial extremity of each of the elongated chambers and allows air to pass into the associated elongated chamber and prevents reverse flow out through the check valve.

In some embodiments first and second check valves in each of the elongated chambers are oriented to allow fluid flow in opposite directions. The second check valve may be disposed at a second axial extremity of each chamber.

BRIEF DESCRIPTION OF THE ACCOMPANYING DRAWING

The invention will be better understood by reference to the accompanying drawing in which.

DESCRIPTION OF THE PREFERRED EMBODIMENTS

Figure 1:
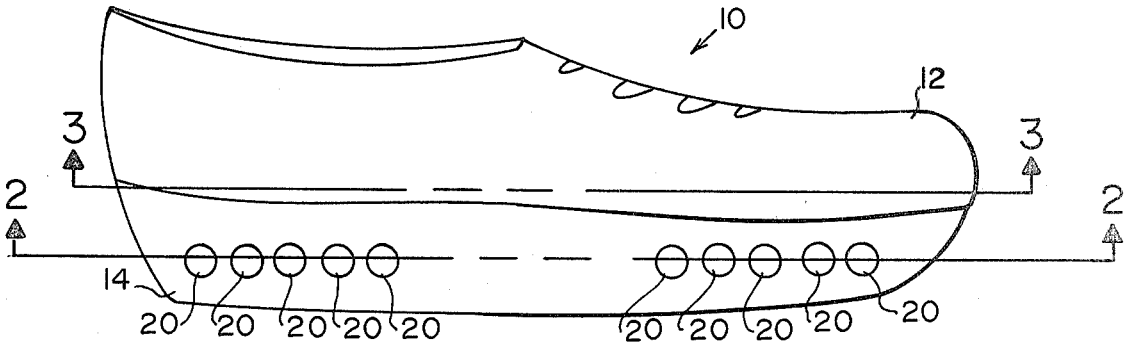
FIG. 1 is an elevational view of a shoe having one form of the apparatus incorporated therein.
Figure 2:
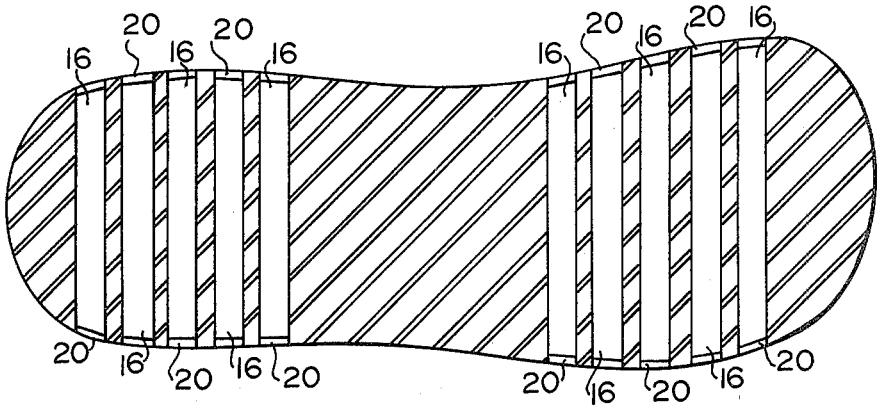
FIG. 2 is a sectional view taken through the general plane of the sole of the shoe illustrated in FIG. 1.
Figure 3:
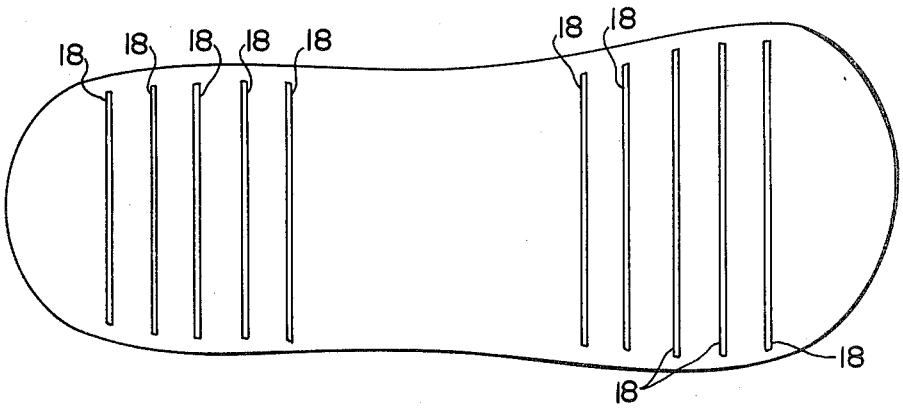
FIG. 3 is a sectional view taken through a plane just above the sole of the shoe illustrated in FIG. 1.

Referring now to FIGS. 1–3, there is shown a first embodiment of the apparatus in accordance with the invention. A shoe 10, having an upper 12 and a sole 14, has a plurality of elongated channels 16 molded in the sole 14. The channels 16 are disposed in parallel side by side relationship and extend in a direction which is generally transverse to the foot of the wearer. In most embodiments of the invention the channels 16 will also be disposed under the heel of the user.

Each channel 16 will be provided with an inlet 20 at the side edge of the sole 14. The inlet 20 will ordinarily be a check valve which allows air flow from the ambient of the shoe 10 into the channel 16. The channel 16 will ordinarily be molded from materials, such as rubber, having a sufficient wall rigidity so that the channel 16 will assume its hollow shape as soon as the weight of the wearer is removed from the sole 4 of the shoe 10. The channel 16 will also have walls that have a sufficient flexibility so that the channel 16 will collapse when the wearer of the shoe 10 steps on the sole 14.

In the embodiment illustrated in FIGS. 1, 2, and 3, the channels 16 are provided with an axially extending slit 18 which communicates with the upper surface of the sole.

Thus, in operation, the user steps on the upper surface of the sole 14 tending to collapse the channels 16 and forcing air out through the slits 18. As the wearer raises his foot he removes the pressure from the channels 16, causing the channels 16 to reassume a hollow shape, which may be a round cross-section or some other cross-section including square, rectangular, oval, or any other form. Accordingly, the ambient air pressure will force its way though the inlet or check valve 20 into the interior of the channels 16. Accordingly, the channels 16 will be ready for another cycle wherein the air within the channels 16 is again forced out through the slits 18.

Figure 4:
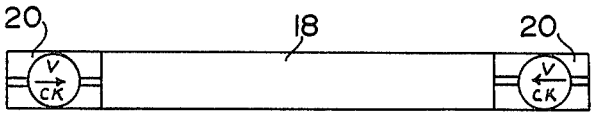
FIG. 4 is a schematic view illustrating a second embodiment of the apparatus in accordance with the invention.

Referring now to FIG. 4, there is shown a second embodiment of the apparatus in accordance with the invention in which the channels 16 are provided with separate check valves 20, 20 at the respective ends thereof. In most embodiments the second check valve 20 will not be required because the slits 18 will function to accomplish the same purpose. In other words, the slits 18 may comprise axially extending overlapping flaps which prevent entrance of air but allow exit of air from the channels 16.

It will be understood that the term "sole" as used herein comprehends both the inner and outer soles in footwear that includes both. The channels 16, in accordance with the invention, may be disposed either in the inner or the outer sole without departing from the spirit of the invention. In running shoes and in sneakers in which the invention is incorporated, there may be no inner sole. The channels 16 may be, in various embodiments of the invention, molded as an integral part of the sole or independently formed and the inserted in the mold in which the sole is formed or may be cut during the stamping operation and openings provided therein to accommodate the channels 16.

In some embodiments of the invention the elongated channels 16 have a slit 18 which is disposed along the upper face of the sole and which may be replaced by a check valve 20 which only allows flow out of the elongated chambers. Thus, the inlet or check valve 20, which is adjacent to the axial extremity which is positioned at the side or ambient of the elongated chamber 16 allows air in and the check valve 20 at the other end of the elongated chamber 16 allows air to flow out. Thus a continuous cycle is possible as the runner or walker moves whereby ambient air is drawn into a first end of an elongated chamber 16, forced out by the stepping action through the second check valve 20, and into the interior of the footwear.

The elongated channels 16 have circular, square, oblong or other cross sections in various embodiments of the invention. The number of elongated channels 16 may vary in different embodiments of the invention. In some the channels 16 may extend under just the ball of the foot and in others under just the heel of the foot.

The invention has been described with reference to its illustrated preferred embodiment. Persons skilled in the art of constructing footwear may, upon exposure to the teachings herein, conceive variations in the mechanical development of the components therein. Such variations are deemed to be encompassed by the disclosure, the invention being delimited only by the appended claims.

Having thus described my invention I claim:

1. A shoe which comprises:

an upper;

a sole having a plurality of elongated chambers disposed therein, said sole having a plurality of slits extending along the top face thereof, each chamber communicating with at least one of said slits and the ambient surrounding the shoe;

a first check valve disposed in each of said elongated chambers to limit the direction of flow in the elongated chamber in which it is disposed to a first direction, said first check valve in each elongated chamber is disposed at a first axial extremity of the elongated chambers and said first check valve allows air to pass into the associated elongated chamber and prevents reverse flow out through said check valve; and a second check valve in each of said elongated chambers substantially at a second axial extremity thereof and which is oriented to allow fluid flow in a direction which is opposite to said first direction.

2. A shoe which comprises:

an upper;

a sole having a plurality of elongated chambers disposed therein, each chamber communicating with at least the top face of the sole and the ambient surrounding the shoe;

a first check valve disposed substantially at the first axial extremity of each of said elongated chambers to limit the direction of flow in the elongated chamber in which it is disposed to a first direction; and a second check valve in each of said elongated chambers substantially at a second axial extremity of and which is oriented to allow fluid flow in a direction which is opposite to said first direction.

* * * * *